US005605263A

United States Patent [19]

Pursley et al.

[11] Patent Number: 5,605,263

[45] Date of Patent: Feb. 25, 1997

[54] HOLDER FOR HEADED TOOLS

[76] Inventors: Richard W. Pursley, 54554-30th St., Paw Paw, Mich. 49079; Stephen D. Roberts, 4640 W. D Ave., Kalamazoo, Mich. 49009

[21] Appl. No.: 544,539

[22] Filed: Oct. 18, 1995

[51] Int. Cl.[6] ..... A45F 5/00; B25B 5/00

[52] U.S. Cl. ..... 224/248; 224/661; 224/666; 224/673; 224/677; 224/678; 224/234; 224/247; 224/269; 224/904; D3/228

[58] Field of Search ..... 224/248, 247, 224/242, 268, 269, 678, 679, 904, 200, 661, 666, 673, 677, 232, 234, 267, 918, 935; D3/220, 228

[56] References Cited

U.S. PATENT DOCUMENTS

| | | | |
|---|---|---|---|
| 1,274,312 | 7/1918 | Nicoll . | |
| 2,956,715 | 10/1960 | Henderson | 224/5 |
| 3,100,590 | 8/1963 | Bohlsen | 224/5 |
| 3,294,298 | 12/1966 | Danielson | 224/5 |
| 3,343,735 | 9/1967 | Breeding et al. | 226/2.6 |
| 5,213,242 | 5/1993 | De Jong | 224/222 |
| 5,232,136 | 8/1993 | Unger | 224/151 |
| 5,232,137 | 8/1993 | Devine | 224/252 |

*Primary Examiner*—Henry J. Recla
*Assistant Examiner*—Timothy L. Maust
*Attorney, Agent, or Firm*—Joseph K. Andonian

[57] ABSTRACT

A device for holding a T-shaped tool having a head and a handle on either the upper or lower leg to (1) provide complete freedom of movement of hands and feet while carrying the tool and (2) permit the user to attach and remove the tool from the device with the same hand employed to use the tool.

7 Claims, 3 Drawing Sheets

HOLDER FOR HEADED TOOLS

This invention relates to a holder for T-shaped headed tools.

TECHNICAL FIELD

This invention relates to a device specifically designed to allow the user to carry a T-shaped headed tool on the outside of the user's leg. It provides a convenient way to carry the tool, permits ready access to the tool by the user, and promotes safety and unobstructed movement by the user.

BACKGROUND OF THE INVENTION

A T-shaped tool such as a hammer can be found in most collections of tools and is often carried on the person of the user while working. Currently marketed holsters or holders for hammers were devised to make it easier to carry the hammer without interfering with free movement of hands and feet. Hammer holsters are generally attached to and hung from a belt. The hammer is generally inserted into the holster by grasping the head and lowering the handle through a loop that fits loosely around the handle but is small enough in diameter to prevent the head from falling through. The hammer head rests in the loop with the handle swinging freely below. The hammer is retrieved by grasping the head and lifting the handle through the loop. Both hands are generally required to turn the hammer around so the user can grip the handle and orient the hammer into the proper position for use. After use, the user must turn the hammer around using both hands again to grip the head to put the handle back through the loop. This system is both impractical and unsafe especially when the user is working on ladders or roofs of buildings and often needs complete freedom to use both hands and feet to move around or steady oneself.

OBJECTS OF THE INVENTION

It is therefore an object of this invention to provide a device for carrying a hammer or similar T-shaped headed tool safely, securely and conveniently without interfering with the free use of hands and feet while carrying the tool.

It is also an object of this invention to provide a holder for carrying a T-shaped tool having a head and a handle and enabling the wearer of the holder to grasp the handle of the tool in the same hand both to use the tool and to place the tool in the holder or remove the tool from the holder.

Other objects will be apparent from the description that follows.

SUMMARY OF INVENTION

The present invention provides an alternative device for carrying a hammer or similar T-shaped tools having a head and a handle on the body in a convenient and secure manner for safe and efficient use. This is accomplished by providing means for securing the hammer to the leg with the head below the handle so the user can grip the hammer by the handle in the same hand during use or holstering. The present device can also be tied to either the upper or lower leg, i.e. above or below the knee. The upper leg or thigh is a better location for a person who works in a standing position, such as a carpenter, and the lower leg or calf is a better location for a person who works on his knees, such as a roofer. When attached to the lower leg, two straps are used to hold the top and bottom of the holder against the leg.

When attached to the upper leg, the top of the holder is attached to a belt worn around the waste of the user and the bottom of the holder is tied to the thigh with a strap, like the holster for a gun. The hammer is firmly held in the holder by both the handle and the head. The handle is secured to the holder by a clamp and the head is nestled in a cradle. The holder is adjustable to hold various sizes and shapes of handles and heads. Guide rails are provided to limit horizontal movement of the handle and a bumper or stop is provided to prevent vertical movement. The designation of movements or positions throughout the present specification and claims, such as horizontal or vertical movements or up and down positions on the holder, assume that the head of the tool is down in the cradle of the holder and the handle is extended upward away from the head like an inverted letter T as it would be if the wearer of the holder is standing in an upright position with the tool in place.

GENERAL DESCRIPTION OF INVENTION

The holder of the present invention is designed to carry a T-shaped headed tool against the outside surface of one leg. A suitable tool has a head and a handle. The holder provides cradle means sized and shaped to hold the head of the tool at the first or lower end of the holder when worn by the user and stop means at the second or upper end of the holder to limit vertical movement of the tool. Clamping means to firmly but retrievably hold the handle of the tool are provided between the stop means and the cradle means. Guide rail means are also provided between the clamp means and the cradle means to limit further the horizontal movement of the handle. Means are also provided for adjusting the distance between the cradle means and stop means to accommodate varying lengths of the tools to be held in the holder. Finally means are provided for attaching the first and second ends of the holder to the upper or lower leg of the user. When worn the holder is designed to hold the tool with the head down and the handle up to permit the wearer of the holder to grasp the handle with the hand in which he intends to use the tool. The wearer of the holder can also replace the tool in the holder with the same hand. The holder is most advantageously worn on the upper leg by users who work in an upright position especially when they need the use of one hand to steady themselves on a ladder while removing or replacing the tool in the holder with the other hand. The holder is most advantageously worn on the lower leg by users who work on their knees such as roofers. Again the tool can be easily removed and replaced with one hand while the other hand is available for other uses.

LIST OF REFERENCE NUMERALS

Figure 1:
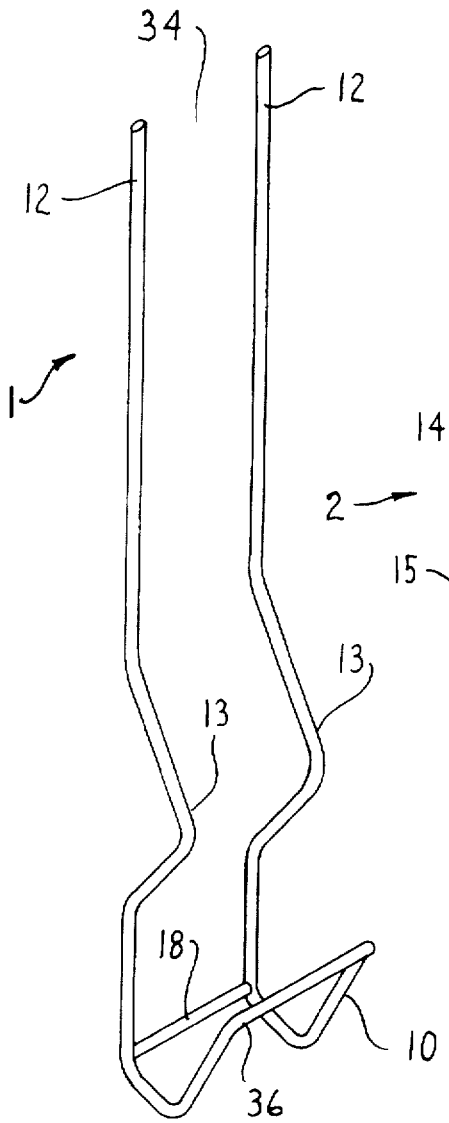
FIG. 1 displays the unassembled component of the holder containing the cradle and the side rails.
Figure 2:
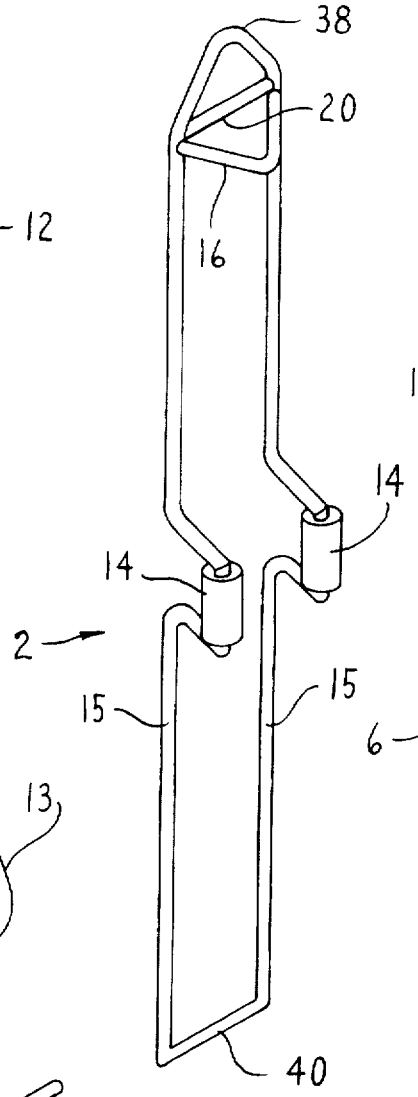
Fig. 2 displays the unassembled component of the holder containing the clamping mechanism and the stop.

1 First component containing cradle and side rails
2 Second component containing clamp and stop
3 Belt-like third component
6 Component 2 fitted between side rails 12 of component 1
8 Assembled holder without straps or belt clip
10 Cradle
12 Side rails of component 1
13 Raised portions of side rails 12
14 Clamp
15 Sides of component 2
16 Stop
18 Reinforcing bar for component 1
20 First reinforcing bar for component 2
22 Back wall of holder
24 Adjusting strap
26 Rivets which attach one end of adjusting strap to back wall
30 Metal strap
32 Rivets which secure components 1 and 2 to the back wall between the stop 16 and the clamp 14
34 Open end of component 1
36 Closed end of component 1
38 Closed end of component 2
40 Second reinforcing bar for component 2
44 Buckle
46 Cut out in wide part of component 3
48 Wide part of component 3
50 First or buckle end of component 3
52 Second or free end of component 3
54 Holes in second end of component 3
56 Slots for an adjustable strap in lower portion of component 3
57 Slots for an adjustable strap in upper portion of component 3
58 Holes for open end of component 1 to pass through component 3

PREFERRED EMBODIMENT OF THE INVENTION

The preferred embodiment of the present invention designed especially to hold a hammer consists essentially of the following four components: (1) a first component 1 consisting of a metal rod configured to provide a cradle 10 for the head of a T-shaped tool and side rails 12 to limit horizontal movement of the tool handle, (2) a second component 2 consisting of a metal rod configured to accommodate a clamp 14 for the handle of the tool and provide both a stop or bumper 16 to limit vertical movement of the tool and a clip for attaching the completed assembly to the belt of the user, (3) a third component 3 consisting of a belt configured to hold the first and second components 1 and 2 together, permit vertical adjustments in the space allotted for holding the tool and provide a back wall for holding the completed assembly against the leg of the wearer, and (4) a fourth component, not shown in the drawings, consisting of either two straps for attaching the completed assembly to the lower leg of the wearer or one strap and a clip for attaching the completed assembly to the upper leg and the belt of the wearer.

The first component 1 is fashioned from a metal rod that is either bent or assembled from individual pieces welded together to form a cradle 10 at the closed end of two parallel side rails 12. The cradle 10 is raised above the plane occupied by the side rails 12 and is sized to hold the head of the hammer. The side rails 12 extend away from the cradle 10 to an open end 34 and a reinforcing rod or bar 18 connects the sides of the metal rods near the bottom of the cradle 10. Opposing portions 13 of the side rails 12 are raised in the same direction as the cradle to limit the horizontal movement of the hammer handle when placed in the holder. The distance between the side rails 12 is slightly greater than the width of the handle of the hammer to be held by the completed assembly.

The second component 2 is fashioned from a metal rod that is sized and either bent or assembled from individual pieces welded together to (i) fit inside and parallel to the side rails 12 of the first component 1, (ii) form a place at its first closed end 38 suitable for attachment of a clip to attach the completed assembly to a belt worn by the user of the invention and (iii) form part of a clamping mechanism 14. The distance between the parallel sides 15 of component 2 permits component 2 to move freely but snugly in a vertical direction between the side rails 12 of component 1. The clamping mechanism 14 is sized to hold the handle of the tool securely when placed in the holder and yet permit manual removal of the tool from the holder with one hand. Two reinforcing rods or bars 20 and 40 connect the two sides 15 of component 2 just inside its first closed end 38 and at its second end which is closed by reinforcing rod 40. A stop or bumper 16 is fitted between the two parallel sides of component 2 in a perpendicular orientation from sides 15 just inside the first end 38 of the second component. The stop 16 limits vertical movement of the tool when placed in the completed holder. Reinforcing rod 18 on component 1 also acts as a stop for component 2 at reinforcing rod 40.

Figure 5:
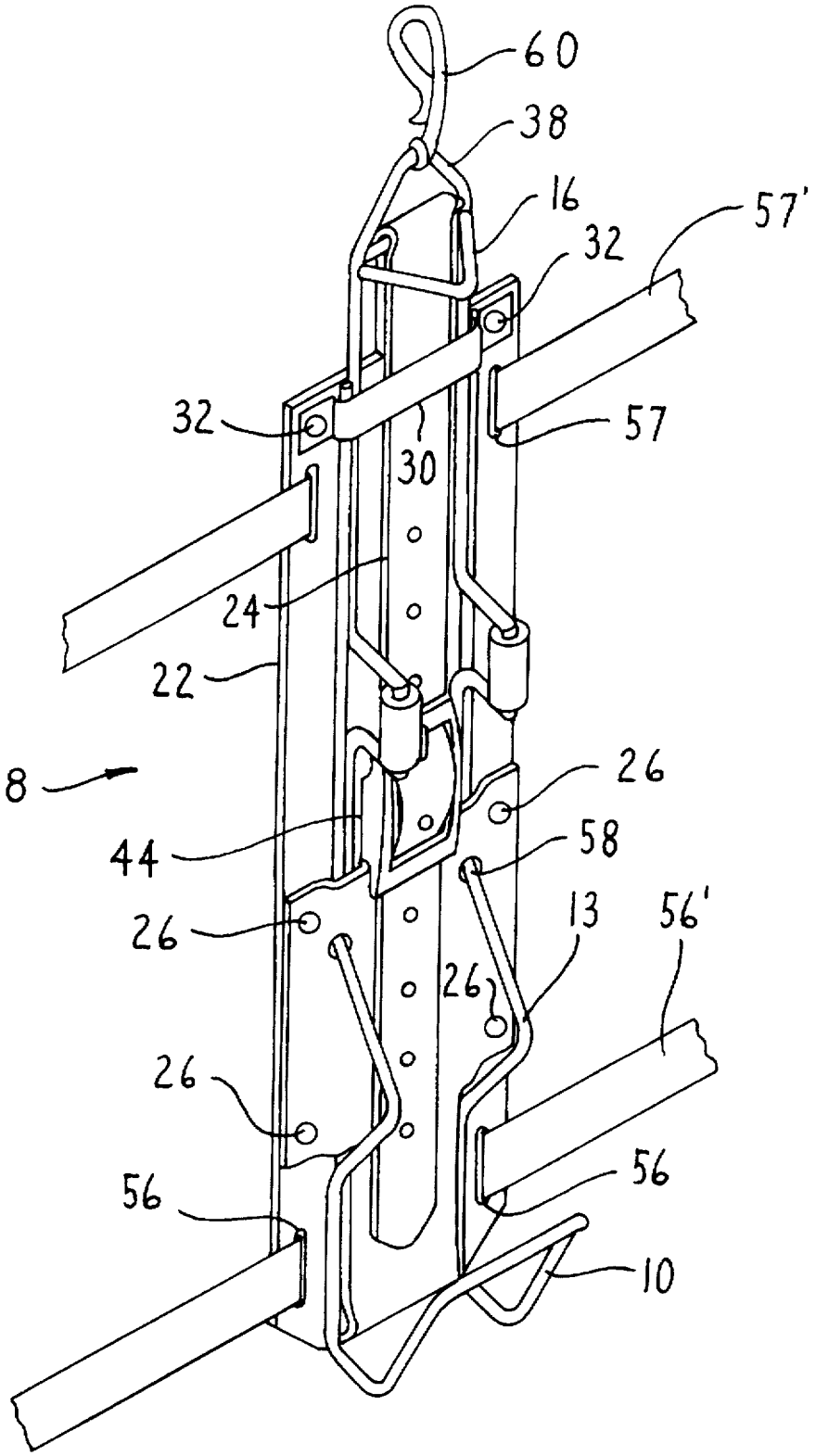
FIG. 5 displays the completely assembled holder except for the strap to attach the holder to the leg of the user or the clip to hang the holder from a belt.

The third component 3 is similar to a belt in its construction and holds the components 1 and 2 together after component 2 is fitted inside side rails 12 of component 1 and enables component 2 to slide between the two side rails 12. It also provides a back wall for the completely assembled holder 8 which can rest against the leg of the wearer on one side of the back wall. Like a belt component 3 is preferably made of leather and has a buckle 44 on its first end 50 and holes 54 punched into its second end 52 which is sized so the second end 52 can be inserted into the buckle 44 and fastened to the first end 50. The first end 50 is configured so it is wide enough just inside the buckle 44 to extend beyond the sides of component 1 followed by a cut out or a narrower portion 46 so it can be folded over the reinforcing rod 18 near the base of the cradle 10 inside the side rails 12 of component 1. The open end 34 of component 1 is fitted through the holes 58 in the wide portion of component 3 just inside the buckle 44 before component 3 is folded over the reinforcing rod 18 as shown in FIG. 5. The wide portion 48 inside the buckle 44 is then stapled or riveted 26 to the equally wide portion 48 of component 3 beyond the cut out 46. The wide portion 48 of component 3 beyond the cut out 46 extends up to the open end 34 of component 1 and becomes the back wall of the completed assembly. A metal strap 30 can be stapled or riveted 32 to the back wall outside the guide rails 12 of component 1 near its open end 34 to secure components 1 and 2 to the back wall.

When the fourth component consists of two adjustable straps (56', 57') for fastening the completed assembly to the lower leg, the straps (56', 57') can be fitted through the paired slots 56 and 57 provided in both ends of the back wall of the holder. When the fourth component consists of a belt clip 60 and a strap, the clip 60 is attached to component 2 above the stop 16 at end 38 and the strap can either be fitted through the slots 56 in the back wall near the cradle 10 or be enclosed between the two wide parts 48 of component 3 before they are stapled or riveted together, the pictured staples being designated collectively by the numeral 26 in FIG. 5.

Figure 3:
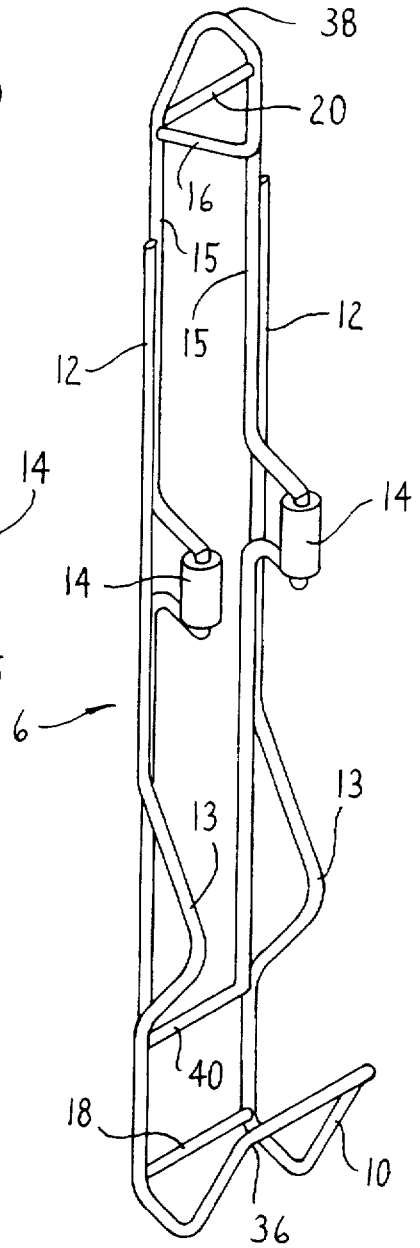
FIG. 3 displays the two components shown in FIGS. 1 and 2 fitted together in the same manner as they would be in the completely assembled holder.
Figure 4:
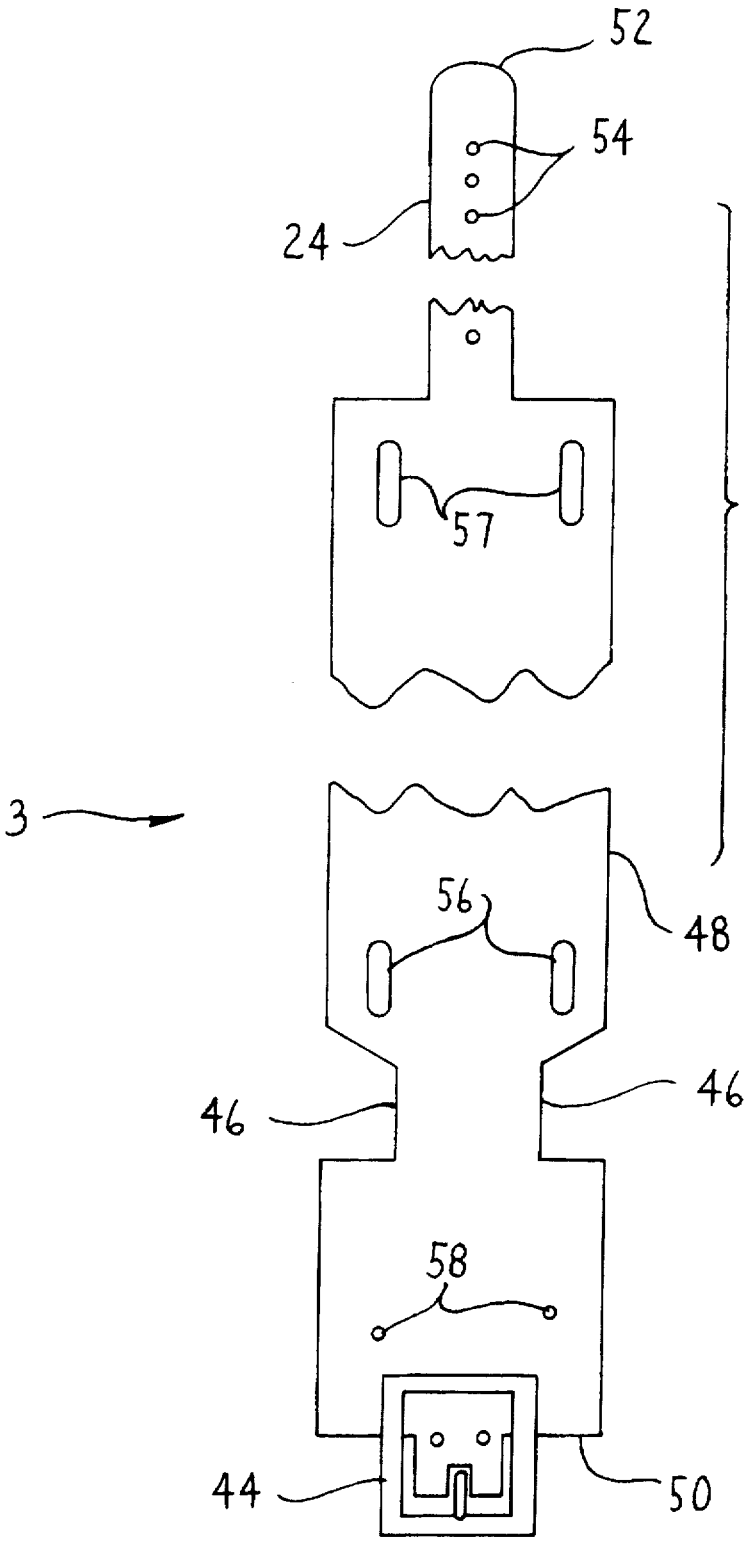
FIG. 4 displays the third or belt-like component before it is folded and assembled with the other components to form the completed assembly.

The length of the completed assembly can be adjusted to fit the length of the tool to be carried in the holder by fastening the free end 52 of component 3 to the clasp of the buckle 44 through the appropriate hole in the free end 52. The holes are designated collectively by the numeral 54 in FIG. 3. Thus fastening the buckle 44 to the first hole would accommodate a longer tool than fastening to the fourth hole because the stop 16 in component 2 would be further from the bottom of the cradle 10.

The clamp 14 depicted in FIG. 5 consists of two rollers attached to the raised portions of the side rails 15 in component 2. The distance between the rollers is adjusted to secure the handle of a tool to the holder. They are also attached to component 2 in a manner which will permit them to spread apart enough to enable the handle of a tool to fit between them and clamp the handle to the holder when they return to their original position. Resilience of the material used to form the rollers, preferably rubber, also contributes to their ability to expand and contract around the handle of the tool.

Using one hand the wearer of the completed holder can lower the head of the tool into the cradle 10 and press the handle into the clamp 14. Again using one hand the wearer can grip the handle of the tool, pull the handle out of the clamp 14, lift the tool out of the cradle 10 and without further manipulation use the tool.

The metal rods of components 1 and 2 are preferably fashioned out of zinc coated steel, but many other metals or plastics are suitable. The rods can be bent to form the desired shapes, or they can be cut into pieces of appropriate sizes and shapes and attached to each other by any appropriate means, such as by welding in the case of metals or fusion in the case of plastics. They can vary in thickness or diameter, cross section (e.g., round or square, hollow or solid). They need only possess sufficient strength to withstand handling during manufacture and use. The clamp 14 can also vary in shape (e.g. round or triangular) and material (e.g. rubber or plastic or combinations thereof). Component 3 can be composed of various materials such as leather, plastic or a tightly woven fabric of any fibrous material. The fourth component can consist of any belting material or, where one end of holder 8 is attached to a belt, a metal or plastic clip. Strength and/or flexibility to withstand normal usage and handling are important considerations in making selections from among the indicated variables.

The advantages of the described invention include the ability of the holder to secure the tool in two separate locations and at various elevations on the leg, to accommodate tools of various lengths with heads Of various sizes and shapes, to restrict vertical movement by the combination of a stop 16 and a cradle 10, and to restrict horizontal movement by the combination of a clamp 14, a cradle 10 and the raised portions 13 of side rails 12.

The products of the invention disclosed herein represent preferred embodiments of the invention. Many other variations are possible but are too numerous to disclose in their entirety. The words and drawings used herein are merely descriptive and illustrative and are not intended as exact representations of or inflexible limitations on the spirit and scope of the invention disclosed herein which can only be measured by the legally valid scope of the appended claims.

What is claimed is:

1. A holder for carrying a T-shaped tool having a head and a handle against the outside surface of one leg comprising cradle means sized and shaped to hold said head at a first end of said holder, stop means to limit further the vertical movement of the said handle at a second end of said holder, clamping means sized and shaped to firmly but retrievably fasten said handle to said holder and located between said cradle means and said stop means, guide rail means between said clamping means and said cradle means configured to limit further the horizontal movement of the handle when said holder is attached to the leg of the holder wearer, means for adjusting the distance between said stop means and said cradle means to match the length of said tool, means for attaching the first and second ends of said holder to the leg of the holder wearer wherein said tool can be placed in and retrieved from said holder by the same hand that said wearer of said holder uses when he uses the said tool.

2. The tool holder of claim 1 wherein said cradle means and said guide rail means are embodied in one component of said holder and said stop means and said clamping means are embodied in a second component of said holder and said second component is adapted to fit slidably between said guide rail means of said first component.

3. The tool holder of claim 1 wherein the means for adjusting the distance between said stop means and said cradle means is embodied in a belt that comprises a fastener at its first end which is wrapped around said first and second components in a fixed position, a second end which is suitable for attachment to said fastener and for adjusting the available distance between the said stop means and said cradle means to accommodate different tool handle lengths.

4. The tool holder of claim 3 wherein the said belt is wide and flexible enough inside said fastener (a) to extend beyond the said guide rail means when the belt is folded over a lower portion of the assembly of the said first and second components to facilitate fastening the two ends of the belt to each other and (b) to provide a back wall for the said holder.

5. The tool holder of claim 1 wherein the means for attaching the said first end of said holder to the upper leg of the said wearer is an adjustable strap and the means for attaching the said second end of said holder to a belt worn at the waste of the wearer is a clip.

6. The tool holder of claim 1 wherein the means for attaching the said first and second ends of said holder to the lower leg of the said wearer are adjustable straps.

7. A device having four components suitable for securing a T-shaped tool having a head and a handle against the leg of the wearer of the device with said handle extending upwardly in relation to said head, said device comprising a first component configured to provide a cradle for said head at its lower end and side rails adapted to limit horizontal movement of said handle extending upwardly in relation to said cradle, a second component configured to fit slidably within the said side rails of said first component, accommodate a clamping mechanism to secure the said handle snugly but removably, provide a stop above said clamp to limit upward movement of the said handle, and accommodate means above said stop to attach the said holder to a belt worn by the wearer of said holder, a third component having fastening means at its first end positioned in a fixed position upward of said cradle and a second end suitable for adjustable attachment to said fastening means wherein said third component is configured to wrap around the assembled first and second components, provide a back wall for holding said holder against the leg of the wearer and permit adjustments in the distance between said stop on said second component and said cradle on said first component by sliding said second component between the side rails of said first component, and a fourth component suitable for attachment to said third component and strapping the assembly of the four components to the leg of the wearer of said holder.

* * * * *